US008286973B1

(12) United States Patent
Song et al.

(10) Patent No.: US 8,286,973 B1
(45) Date of Patent: Oct. 16, 2012

(54) ANIMAL IMITATING TRICYCLE

(76) Inventors: Wei Song, Houston, TX (US); Feng Zhu, Chang Tu (CN); Ning Zhu, Beijing (CN)

( * ) Notice: Subject to any disclaimer, the term of this patent is extended or adjusted under 35 U.S.C. 154(b) by 0 days.

(21) Appl. No.: 13/385,044

(22) Filed: Jan. 28, 2012

(51) Int. Cl.
*A63G 17/00* (2006.01)

(52) U.S. Cl. ..... 280/1.13; 280/1.165; 280/1.167

(58) Field of Classification Search ..... 280/1.13, 280/1.16, 1.165, 1.167, 1.181, 1.192, 1.204
See application file for complete search history.

(56) References Cited

U.S. PATENT DOCUMENTS 1,269,490 A * 6/1918 Murray et al. ..... 280/1.181
1,369,628 A * 2/1921 Dahl ..... 280/1.181
2,627,419 A * 2/1953 Lindenbein ..... 280/1.203
2,712,450 A * 7/1955 Fox ..... 280/1.181
3,628,801 A 12/1971 Cambrecht
4,546,989 A 10/1985 Peterson
4,746,135 A 5/1988 Oh
5,501,476 A 3/1996 Howell
5,549,313 A * 8/1996 James et al. ..... 280/221

* cited by examiner

*Primary Examiner* — Tony Winner

(57) ABSTRACT

A non-motorized tricycle including: a animal imitating shell for supporting a rider; two front wheels and one rear wheel; a steering means pivotally supported by frame; A pedal-crank provided with a pedal linked to a driving-crank by a transmitting-rod; a long-arm crank secured to a driving-crank at one end and pivoted with a kicking-rod at other end; a one-way driving-wheel provided at lower end of the kicking-rod. While a rider pedals down pedals, the kicking-rod would kick backward and push the vehicle to move forward.

6 Claims, 6 Drawing Sheets

ANIMAL IMITATING TRICYCLE

CROSS-REFERENCE TO RELATED APPLICATIONS

None.

FEDERALLY SPONSORED RESEARCH

None.

SEQUENCE LISTING OR PROGRAM

None.

BACKGROUND OF THE INVENTION

1. The Field of the Invention

The present invention relates to a tricycle, particularly for recreational use by children.

2. Description of the Prior Art

Conventionally, children's tricycles are both steered and propelled via single front wheel. Considerable power is required to propel such tricycles. Therefore, children, particularly small children, soon tired of pedaling such a tricycle. So they are not used frequently as desired.

There are also tricycles whose foot-operated pedals are linked, via rods, to a crank as associated with rear wheels of the tricycle. Tricycles of this type also require considerable power, which makes them difficult for children to use. Vehicle like this is disclosed in U.S. Pat. No. 4,746,135 (issued on May 24, 1988). Since the front pedals turn with the rear wheels via cranks together, the rider's feet must assume an awkward position during turning. Moreover, if the rider's feet can not catch up with the turning pedals their feet are likely to impact them due to moment of inertia of turning rear wheels, causing injury.

SUMMARY OF THE INVENTION

It is a main object of the present invention to provide a novel model tricycle with replaceable animal style shells which is propelled by foot power, steered by means of hands and avoid impacting rider's feet. As a result, a child would be more likely to use such a tricycle more frequently and for longer period of time, thereby obtaining the benefits attended to such use.

The above and other objects are achieved according to the invention, by a animal-imitating tricycle comprising: a frame having a animal style shell with a seat for supporting a rider; two front wheel and a rear wheel; steering means pivotally supported by the frame and supporting the front wheels; (explanation will hereafter be given on one half side of the present invention for simplicity), crank driving means composed of a pedal with a pedal-crank rotationally mounted on the frame; a driving-crank secured to the pedal-crank, a transmitting-crank rotationally supported by the frame and linking with the driving-crank via a transmitting-rod; a long-arm crank secured to the transmitting-crank via a axle; a kicking rod pivoted with the long-arm crank at upper end and provided with a one-way driving-wheel at lower end; a spring with both ends secured to the frame and the transmitting-rod; and a removable pushing rod.

BRIEF DESCRIPTION OF THE DRAWINGS

Preferred embodiment of the present invention will now be described with reference to drawings in which.

DESCRIPTION OF THE PREFERRED EMBODIMENT

Figure 1:
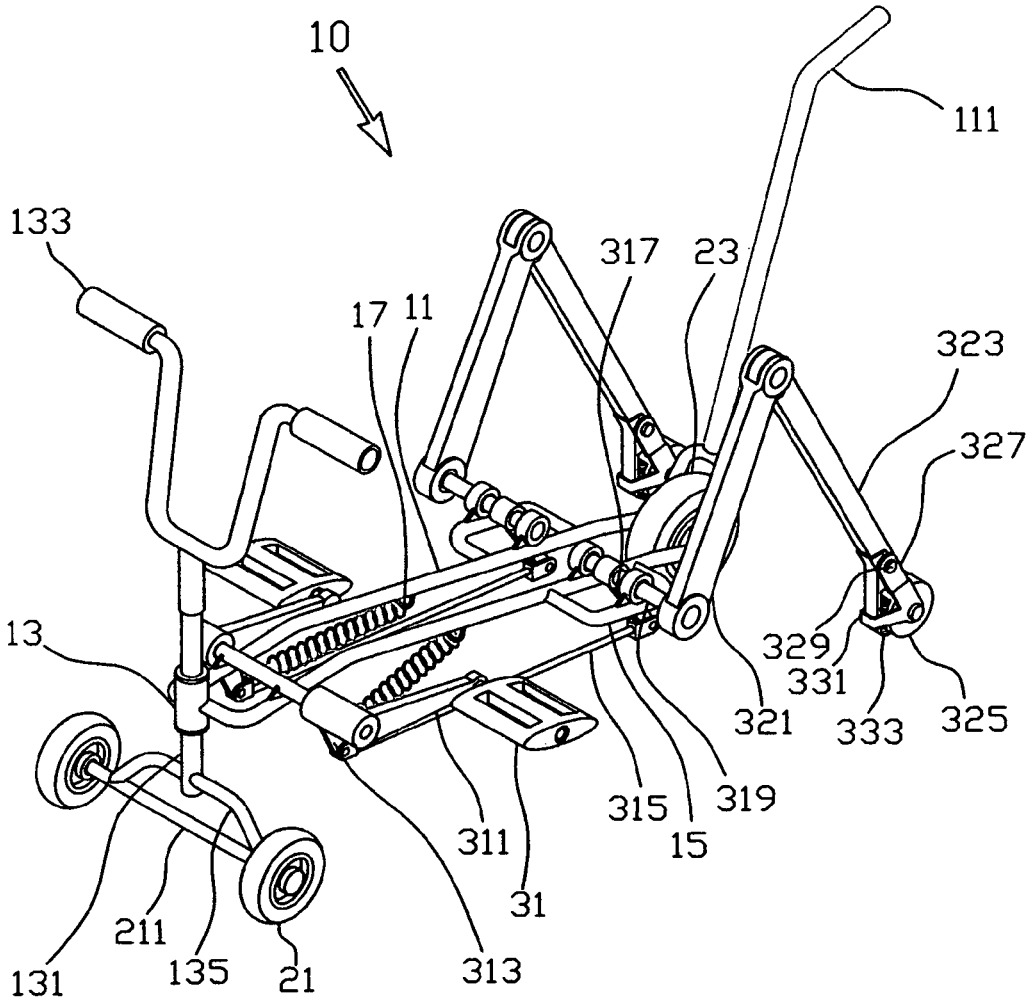
FIG. 1 is a perspective view of interior structure of the present invention.
Figure 2:
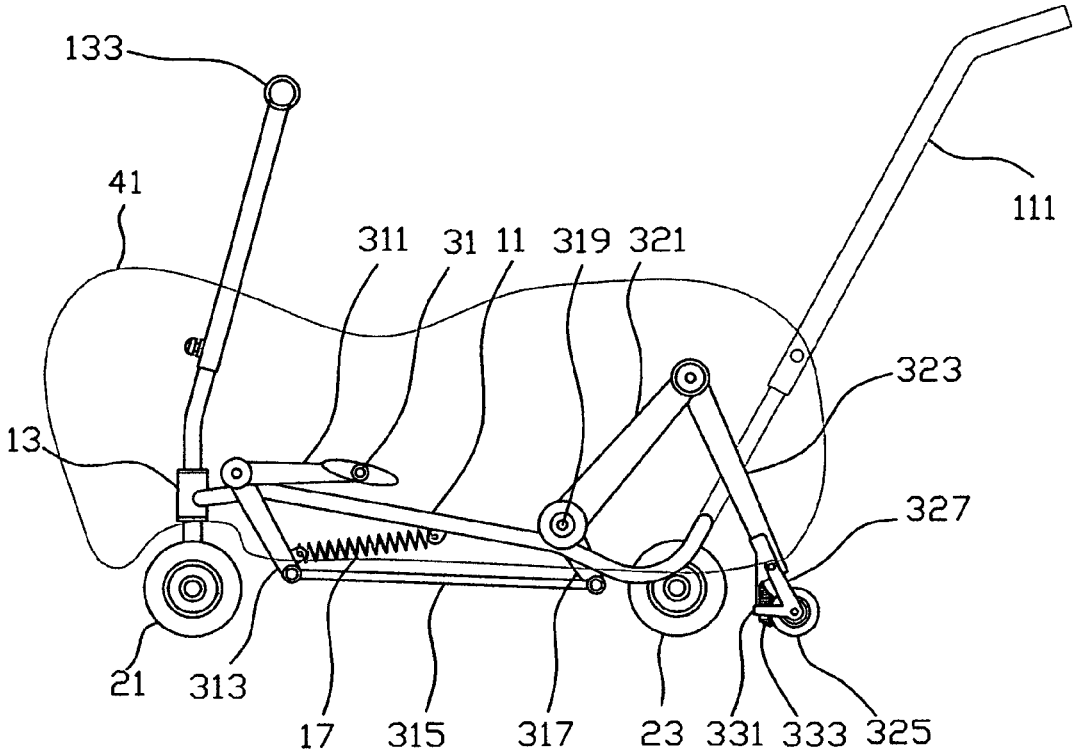
FIG. 2 is a side view of the interior structure.
Figure 3:
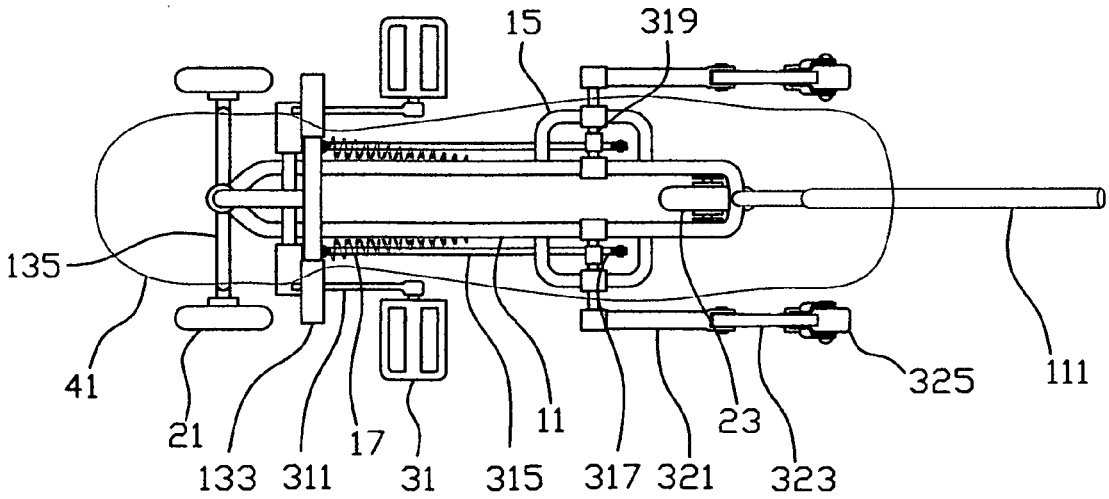
FIG. 3 is a vertical view of the of interior structure.

The tricycle shown in FIGS. 1, 2 and 3 includes:

A interior structure 10 covered with animal style shell 41;

Main frame 11;

Steering-post 13 and bracket 15, Steering-post 13 houses a steering shaft 131 provided with a handlebar 133 at upper end and a yoke 135 holding axle 211 rotationally supporting front wheels 21;

Rear wheel 23 is rotationally mounted on the rear portion of main frame 11;

Pedal-crank 311 provided with pedal 31 is secured to driving-crank 313 rotationally supported by main frame 11;

Transmitting-rod 315 is engaged to link driving-crank 313 and transmitting-crank 317 secured to transmitting-axle 319 supported rotationally by main frame 11 and bracket 15;

Kicking-rod 323 is pivoted at its upper end with long-arm crank 321 secured to transmitting-crank 317 at another end and provided at lower end with one-way driving-wheel 325;

Spring 17 is secured with both ends to main frame 11 and driving-crank 313;

Removable pushing-rod 111 is provided onto rear end of main frame 11 with screw.

Figure 4:
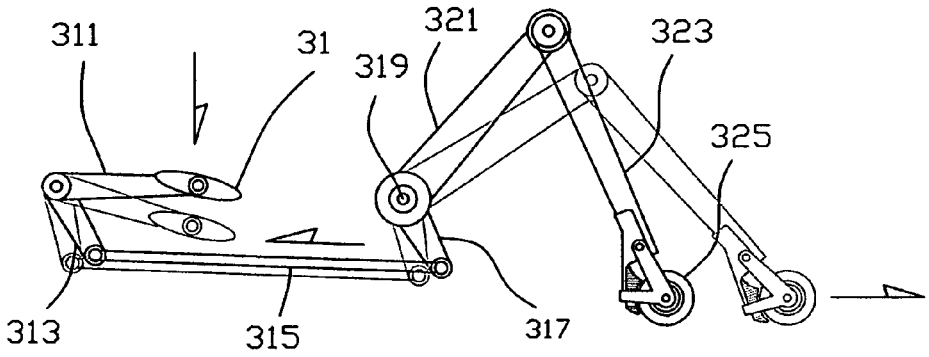
FIG. 4 is a diagram of driving principle.

As shown in FIG. 4, is the working principle of driving crank means. While pedal 31 is pedaled downwards, as shown in light line, driving-crank 313 will turn forwards and at the same time, transmitting-rod 315 move forwards too, pulling transmitting-crank 317 move in the same direction and making upper end of long-arm crank 321 turn back-downwards. As a result, kicking-rod 323 will be forced to change its position in such a way that upper end of it has to move together with the upper end of long-arm crank 321 and one-way driving-wheel 325 has to be move backwards along the ground. Due to driving-wheel 325 would be automatically locked while it starts to move backwards, the vehicle will move forward by the reacting force.

Figure 5:
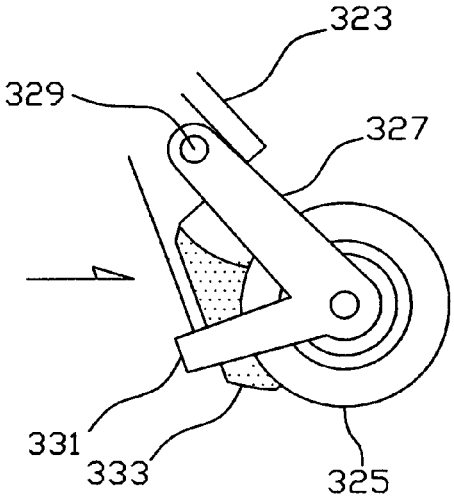
FIG. 5 is a detail side view of one-way driving-wheel in kicking-back state.

FIG. 5 shows a driving state of one-way driving-wheel 325. While kicking-rod 323 kicks backwards as shown in the direction of arrow, side-bracket 327 together with driving-wheel 325 will be forced to rotate forward around pivotal axle 329 and the front periphery of driving-wheel 325 will touch brake-shoe 333 and stop rolling.

Figure 6:
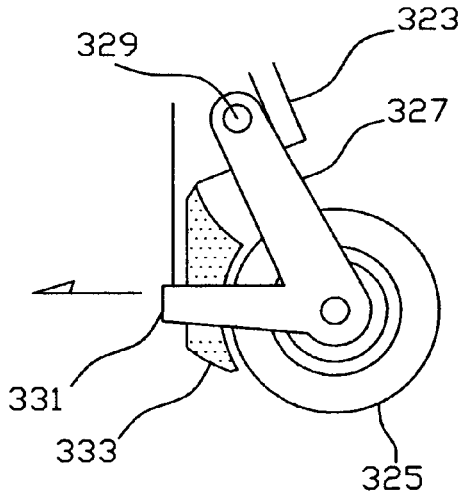
FIG. 6 is a detail side view of the one-way driving-wheel in coasting state.

FIG. 6 shows a coasting state of one-way driving-wheel 325. While kicking-rod 323 moves forward and recover to its initial position by the aid of spring 17 as shown in the direction of arrow, the side-bracket 327 and the one-way driving wheel 325 will move backwards and due to friction of the ground, the front periphery of driving-wheel 325 will separate from brake-shoe 333, free to roll again. U-shape limiter 331 will touch the back of brake-shoe 333, stopping driving-wheel 325 to slide backwards further.

Figure 7:
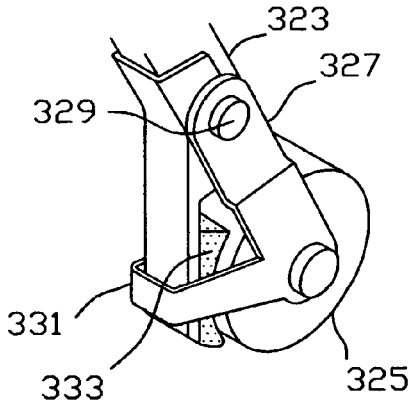
FIG. 7 is a detail of perspective view of driving-wheel.
Figure 8:
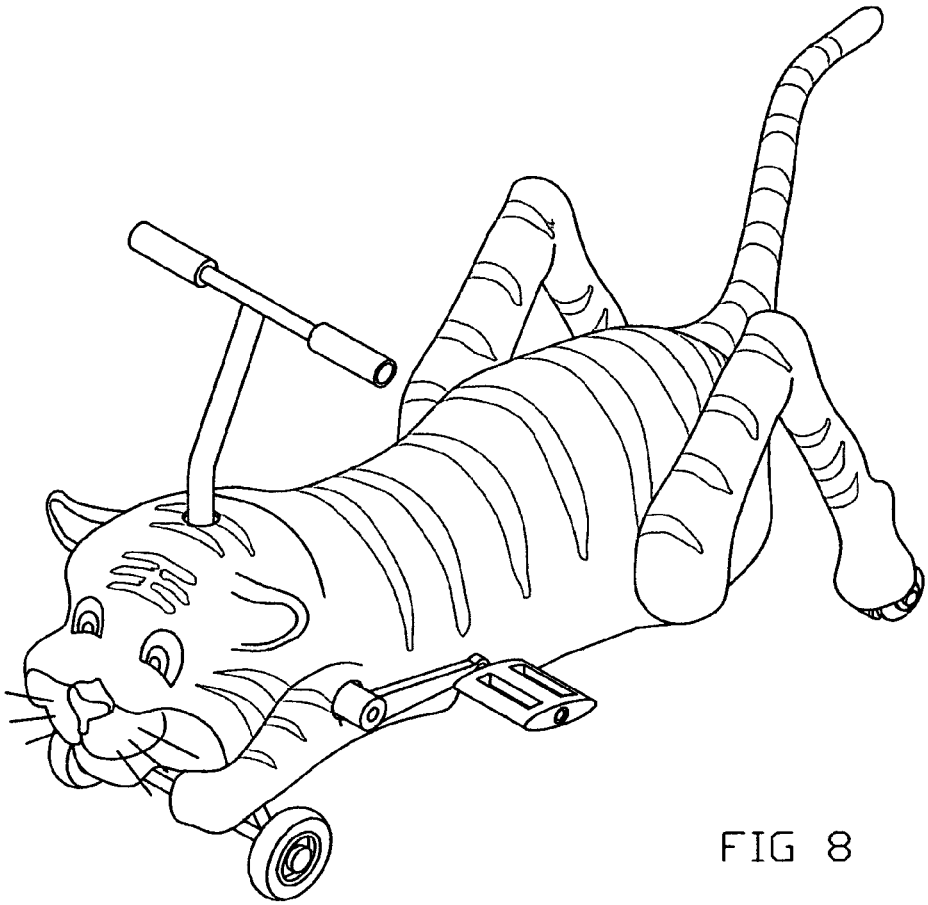
FIG. 8 is a perspective view of one embodiment of the present invention.
Figure 9:
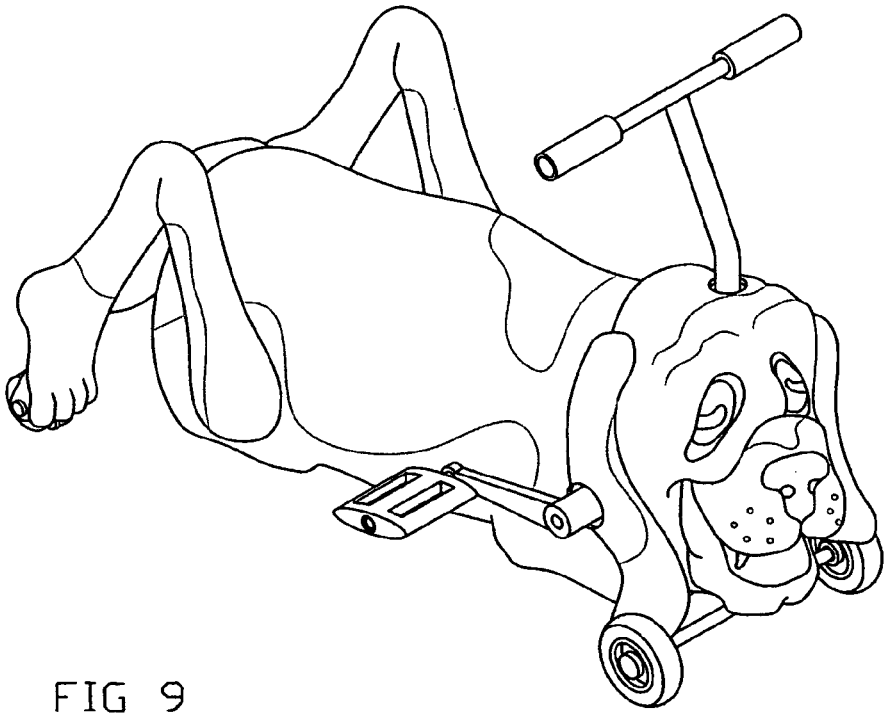
FIG. 9 is a perspective view of another embodiment of the present invention.
Figure 10:
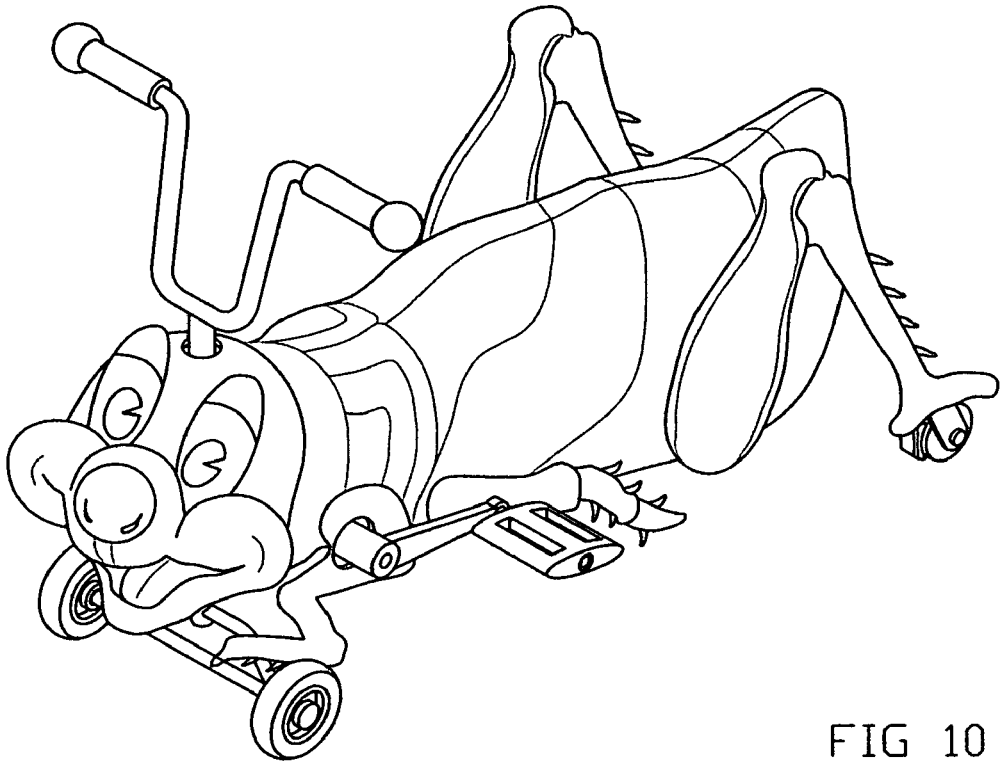
FIG. 10 is a perspective view of another embodiment of the present invention.
Figure 11:
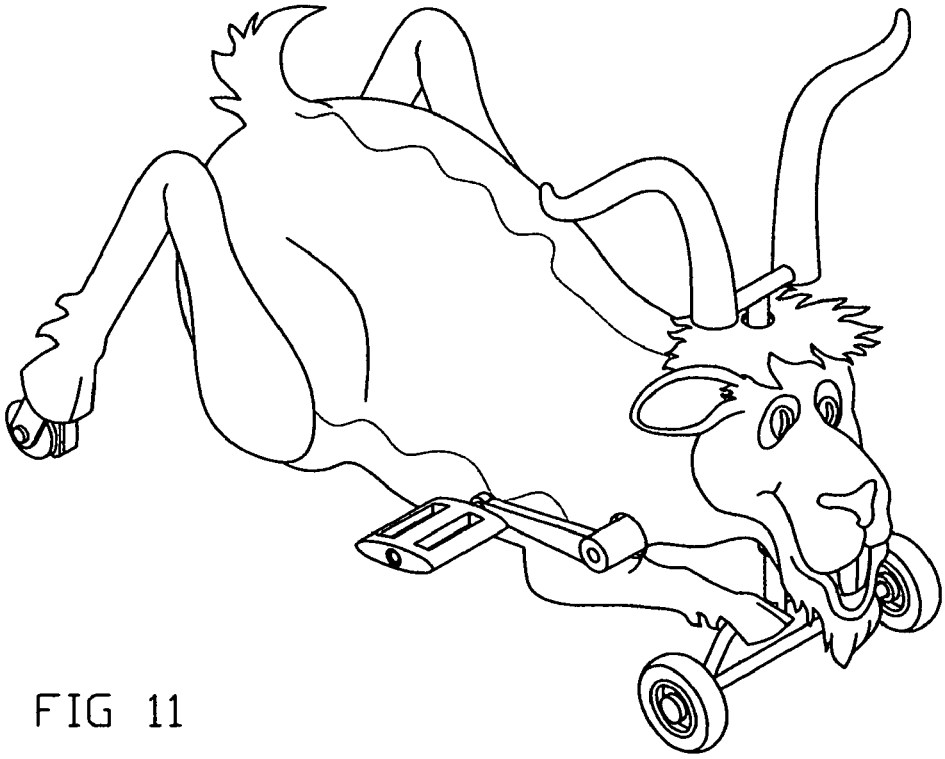
FIG. 11 is a perspective view of another embodiment of the present invention.

FIG. 7 shows the perspective view of the one-way driving-wheel.

FIGS. 8, 9, 10 and 11 shows different animal styles of the embodiments of the invention. The form of the handlebar can be changed according to the different animal style.

Figure 12:
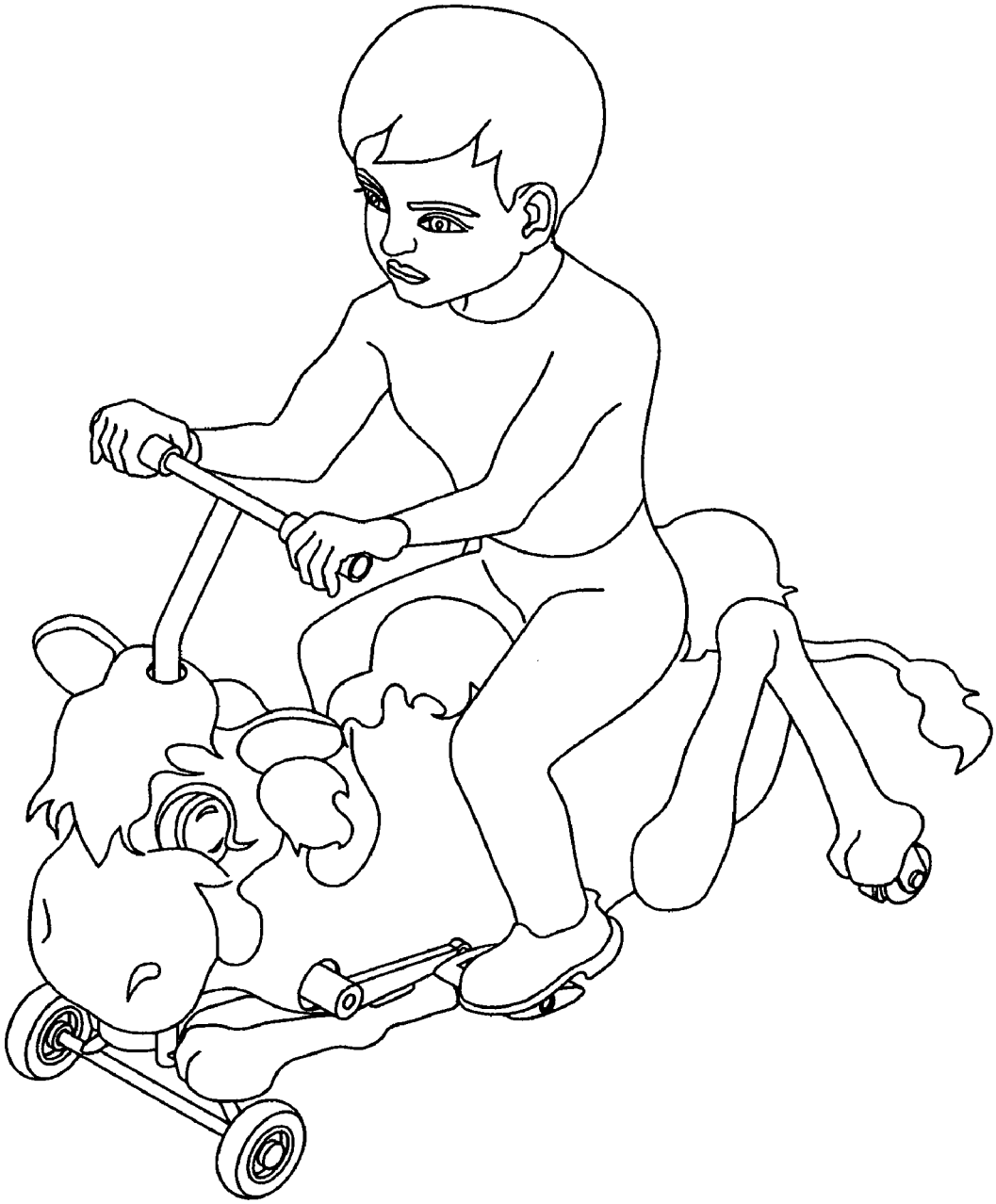
FIG. 12 is a operating way of the embodiments of the present invention.

FIG. 12 shows the operating way of the invention. A rider pedals down with his feet together or separately. The two sides of driving system are independent.

Although preferred embodiments of the present invention have been shown in the foregoing specification, it will, of course, be understood that various modifications and changes may be made therein without departing from the invention. It is therefore, intended that the following claims cover all such modifications and changes as may fall within the true spirit and scope of the present invention.

What is claimed is:

1. An animal imitating tricycle comprising:

an animal style shell;

a main frame;

two front wheels and a rear wheel;

a steering means pivotally connected to said main frame and support by said front wheels;

a crank driving means comprised of a pedal provided with a pedal-crank rotationally mounted on said main frame;

a driving-crank secured to said pedal-crank;

a transmitting-crank linked to said driving-crank via a transmitting-rod;

a long-arm crank secured to said transmitting-crank by a transmitting axle;

a kicking-rod pivotally connected with an upper end to said long-arm crank and provided with a driving device at its lower end;

at least one spring securely attached to said main frame and said driving-crank.

2. The animal imitating tricycle as defined in claim 1 wherein said driving device comprised of a one-way driving-wheel rotationally supported by a side-bracket and a brake-shoe secured to said kicking-rod.

3. The animal imitating tricycle as defined in claim 1 and 2 wherein said driving device is pivotally connected to the lower end of said kicking-rod to allow some degrees of rotation.

4. The animal imitating tricycle as defined in claim 2 wherein said side-bracket is provided with a U-shape limiter.

5. The animal imitating tricycle as defined in claim 1 wherein said tricycle can be adapted for mounting with other animal shells.

6. The animal imitating tricycle as defined in claim 2, wherein the at least one spring includes a second spring.

* * * * *